US010658752B2

(12) United States Patent
Zeine et al.

(10) Patent No.: US 10,658,752 B2
(45) Date of Patent: May 19, 2020

(54) ANTENNA APERTURE EXPANSION FLAPS

(71) Applicant: Ossia Inc., Bellevue, WA (US)

(72) Inventors: Hatem I. Zeine, Bellevue, WA (US); Caner Guclu, Bellevue, WA (US)

(73) Assignee: OSSIA INC., Bellevue, WA (US)

( * ) Notice: Subject to any disclaimer, the term of this patent is extended or adjusted under 35 U.S.C. 154(b) by 52 days.

(21) Appl. No.: 15/983,863

(22) Filed: May 18, 2018

(65) Prior Publication Data

US 2019/0356050 A1 Nov. 21, 2019

(51) Int. Cl.

| | |
|---|---|
| ***H01Q 3/36*** | (2006.01) |
| ***H01Q 19/10*** | (2006.01) |
| ***H01Q 3/46*** | (2006.01) |
| ***H01Q 3/20*** | (2006.01) |
| ***H01Q 3/24*** | (2006.01) |
| ***H01Q 15/00*** | (2006.01) |
| ***H01Q 21/28*** | (2006.01) |

(52) U.S. Cl.

CPC ..... *H01Q 3/36* (2013.01); *H01Q 3/20* (2013.01); *H01Q 3/24* (2013.01); *H01Q 3/46* (2013.01); *H01Q 15/002* (2013.01); *H01Q 19/10* (2013.01); *H01Q 21/28* (2013.01)

(58) Field of Classification Search

CPC ..... H01Q 3/36; H01Q 19/10; H01Q 3/46; H01Q 21/28; H01Q 3/20; H01Q 3/24; H01Q 15/002

USPC ..... 343/834

See application file for complete search history.

(56) References Cited

U.S. PATENT DOCUMENTS

2007/0229357 A1* 10/2007 Zhang ..... H01Q 3/24 343/700 MS
2012/0081255 A1* 4/2012 Gunnels ..... H01Q 9/16 343/725
2018/0205257 A1* 7/2018 Kwon ..... H05K 7/20
2019/0140487 A1 5/2019 Zeine et al.

OTHER PUBLICATIONS

Samuel A. Rotenberg et al., An Efficient Rectifier for an RDA Wireless Power Transmission System Operating at 2.4GHz, (32nd URSI GASS) Aug. 19-26, 2017, Montreal, Canada.
U.S. Appl. No. 15/852,348, filed Dec. 2017, Zeine et al.
U.S. Appl. No. 15/962,479, filed Apr. 2015, Zeine et al.

* cited by examiner

*Primary Examiner* — Hai V Tran
(74) *Attorney, Agent, or Firm* — Volpe and Koenig, P.C.

(57) ABSTRACT

Embodiments of an aperture expansion flap are disclosed. An aperture expansion flap may be used in conjunction with an antenna to expand an effective aperture of the antenna beyond its physical area, geometry, and orientation. An aperture expansion flap may include one or more resonators which may be tuned to adjust a reflection and/or refraction phase of an incident wireless signal, such that the wireless signal may be reflected and/or refracted at angle of reflection and/or refraction that is different than an angle of incidence.

20 Claims, 10 Drawing Sheets

500

ANTENNA APERTURE EXPANSION FLAPS

The embodiments described herein are aperture expansion flaps for an antenna.

BACKGROUND

A conventional antenna system is limited by its particular placement, orientation, and configuration. Likewise, an effective aperture of the conventional antenna system is limited by its physical area, geometry, and orientation. Placement and installation of the conventional antenna system may be difficult and performance of the conventional antenna system may be highly dependent upon its surroundings and physical environment.

Therefore, a need exists to provide an antenna with the ability to expand its effective aperture beyond its original physical area, geometry, and orientation. Additionally a need exists to add dimensions of freedom to the antenna to adjust its radiation pattern, angular coverage, directivity, and adaptation to its surrounds.

SUMMARY

Disclosed herein are embodiments of an aperture expansion flap and methods of operation thereof. In one embodiment, the aperture expansion flap may be configured to operate in conjunction with an antenna. The aperture expansion flap may include a plurality of resonators, wherein each resonator of the plurality of resonators may be tuned to reflect and/or refract an incident wireless signal with a respective adjusted phase, such that an effective aperture of the antenna is increased.

In another embodiment, the plurality of resonators may be arranged in one or more super cells. Each of the one or more super cells may include a respective set of resonators of the plurality of resonators that may be arranged along a length of a respective super cell.

In another embodiment, a first resonator at a first end of a first super cell may be tuned to reflect and/or refract the incident wireless signal with a first adjusted phase. A last resonator at another end of the first super cell may be tuned to reflect and/or refract the incident wireless signal with a last adjusted phase. The first adjusted phase may be less than the last adjusted phase, and each resonator arranged along the length of the first super cell may be respectively tuned to reflect and/or refract the incident wireless signal with a monotonically larger adjusted phase from the first adjusted phase of the first resonator at the first end of the first super cell to the last adjusted phase of the last resonator at the another end of the first super cell.

In another embodiment, all of the respective sets of resonators of the one or more super cells may be arranged in a same order.

In another embodiment, each resonator of the plurality of resonators may be tuned to select a reflection and/or refraction angle with which to reflect and/or refract the incident wireless signal.

In another embodiment, each resonator may be tuned by active circuit components.

In another embodiment, a wave incident upon the aperture expansion flap may be reflected and/or refracted at a reflection and/or refraction angle that is different than an angle of incidence.

In another embodiment, the reflection and/or refraction angle may be selectable based on a desired directionality of transmission.

In another embodiment, the antenna may be part of wireless power transmission system (WPTS).

In another embodiment, the plurality of resonators may be configured to dynamically reflect and/or refract the incident wireless signal to a current location of a wireless power receiver client (WPRC).

DETAILED DESCRIPTION OF THE PREFERRED EMBODIMENTS

Figure 1:
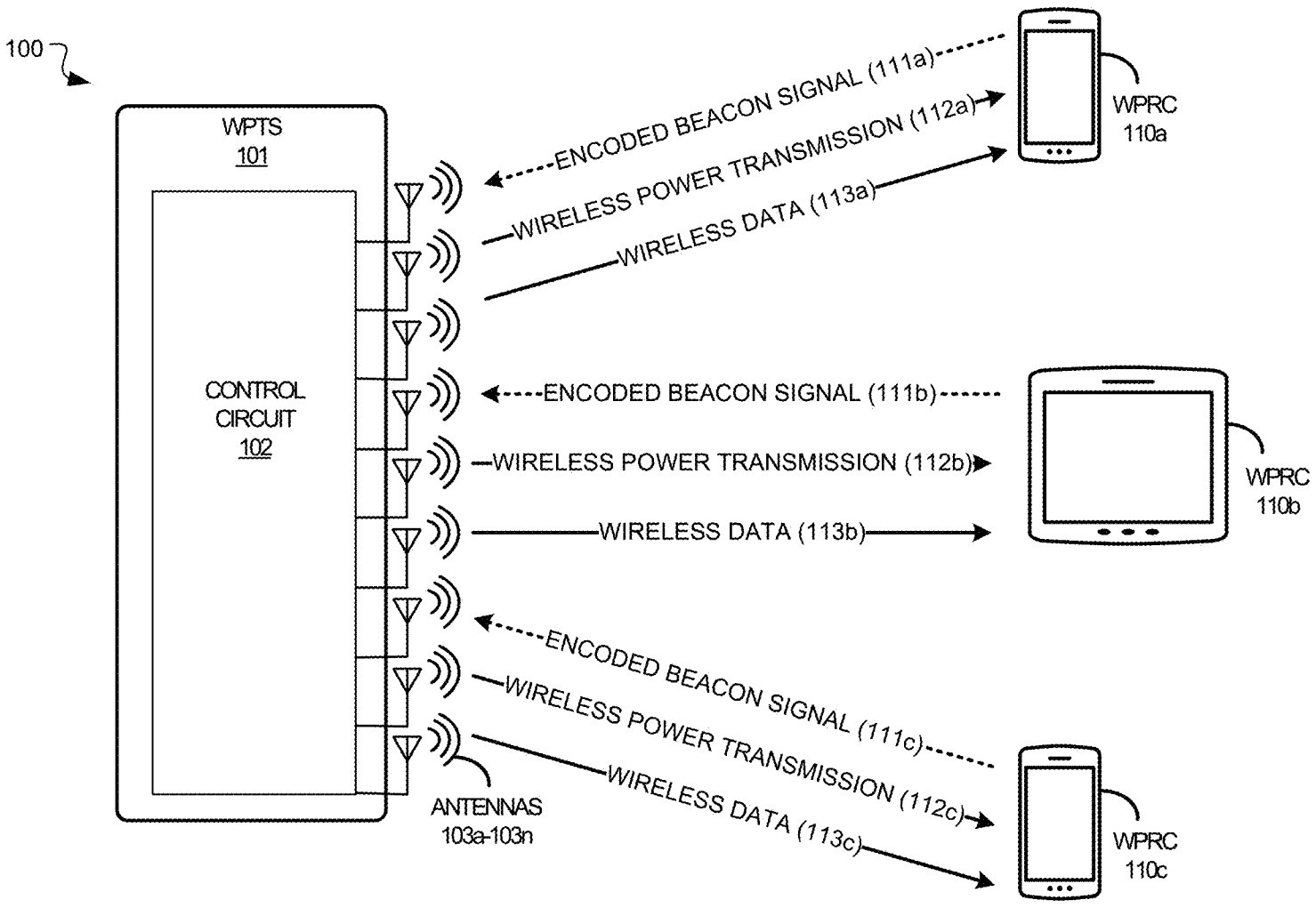
FIG. 1 depicts a system diagram including an example wireless power transmission environment.

FIG. 1 depicts a system diagram including an example wireless power transmission environment 100 illustrating wireless power delivery from one or more wireless power transmission systems (WPTSs), such as WPTS 101. More specifically, FIG. 1 illustrates power transmission to one or more wireless power receiver clients (WPRCs) 110*a*-110*c*. WPTS 101 may be configured to receive encoded beacons 111*a*-111*c* from and transmit wireless power 112*a*-112*c* and wireless data 113*a*-113*c* to WPRCs 110*a*-110*c*. WPRCs 110*a*-110*c* may be configured to receive and process wireless power 112*a*-112*c* from one or more WPTSs, such as WPTS 101. Components of an example WPTS 101 are shown and discussed in greater detail below, as well as in FIG. 2. Components of an example WPRC 110*a*-110*c* are shown and discussed in greater detail with reference to FIG. 3.

WPTS 101 may include multiple antennas 103*a*-103*n*, e.g., an antenna array including a plurality of antennas, which may be capable of delivering wireless power 112*a*-112*c* to WPRCs 110*a*-110*c*. In some embodiments, the antennas are adaptively-phased radio frequency (RF) antennas. The WPTS 101 may be capable of determining the appropriate phases with which to deliver a coherent power transmission signal to WPRCs 110*a*-110*c*. Each antenna of the antenna array including antennas 103*a*-103*n* may be configured to emit a signal, e.g. a continuous wave or pulsed power transmission signal, at a specific phase relative to each other antenna, such that a coherent sum of the signals transmitted from a collection of the antennas is focused at a location of a respective WPRC 110*a*-110*c*. Although FIG. 1 depicts wireless signals including encoded beacon signals 111*a*-111*c*, wireless power transmission 112*a*-112*c*, and wireless data 113*a*-113*c* each being transmitted by or received by a single antenna of the antennas 103*a*-103*n* of the WPTS 101, this should not be construed as limiting in any way. Any number of antennas may be employed in the reception and transmission of signals. Multiple antennas, including a portion of antennas 103*a*-103*n* that may include all of antennas 103*a*-103*n*, may be employed in the transmission and/or reception of wireless signals. It is appreciated that use of the term "array" does not necessarily limit the antenna array to any specific array structure. That is, the antenna array does not need to be structured in a specific "array" form or geometry. Furthermore, as used herein the term "array" or "array system" may be used include related and peripheral circuitry for signal generation, reception and transmission, such as radios, digital circuits and modems.

As illustrated in the example of FIG. 1, antennas 103*a*-103*n* may be included in WPTS 101 and may be configured to transmit both power and data and to receive data. The antennas 103*a*-103*n* may be configured to provide delivery of wireless radio frequency power in a wireless power transmission environment 100, to provide data transmission, and to receive wireless data transmitted by WPRCs 110*a*-110*c*, including encoded beacon signals 111*a*-111*c*. In some embodiments, the data transmission may be through lower power signaling than the wireless radio frequency power transmission. In some embodiments, one or more of the antennas 103*a*-103*n* may be alternatively configured for data communications in lieu of wireless power delivery. In some embodiments, one or more of the power delivery antennas 103*a*-103*n* can alternatively or additionally be configured for data communications in addition to or in lieu of wireless power delivery. The one or more data communication antennas are configured to send data communications to and receive data communications from WPRCs 110*a*-110*c*.

Each of WPRCs 110*a*-110*c* may include one or more antennas (not shown) for transmitting signals to and receiving signals from WPTS 101. Likewise, WPTS 101 may include an antenna array having one or more antennas and/or sets of antennas, each antenna or set of antennas being capable of emitting continuous wave or discrete (pulse) signals at specific phases relative to each other antenna or set of antennas. As discussed above, WPTSs 101 is capable of determining the appropriate phases for delivering the coherent signals to the antennas 103*a*-103*n*. For example, in some embodiments, delivering coherent signals to a particular WPRC can be determined by computing the complex conjugate of a received encoded beacon signal at each antenna of the array or each antenna of a portion of the array such that a signal from each antenna is phased appropriately relative to a signal from other antennas employed in delivering power or data to the particular WPRC that transmitted the beacon signal. The WPTS 101 can be configured to emit a signal (e.g., continuous wave or pulsed transmission signal) from multiple antennas using multiple waveguides at a specific phase relative to each other. Other techniques for delivering a coherent wireless power signal are also applicable such as, for example, the techniques discussed in U.S. patent application Ser. No. 15/852,216 titled "Anytime Beaconing In A WPTS" filed Dec. 22, 2017, in U.S. patent application Ser. No. 15/852,348 titled "Transmission Path Identification based on Propagation Channel Diversity" filed Dec. 22, 2017, in U.S. patent application Ser. No. 15/962,479 titled "Directional Wireless Power and Wireless Data Communication" filed Apr. 25, 2018; which are expressly incorporated by reference herein.

Although not illustrated, each component of the wireless power transmission environment 100, e.g., WPRCs 110*a*-110*c*, WPTS 101, can include control and synchronization mechanisms, e.g., a data communication synchronization module. WPTS 101 can be connected to a power source such as, for example, a power outlet or source connecting the WPTSs to a standard or primary alternating current (AC) power supply in a building. Alternatively, or additionally, WPTS 101 can be powered by a battery or via other mechanisms, e.g., solar cells, etc.

As shown in the example of FIG. 1, WPRCs 110*a*-110*c* include mobile phone devices and a wireless tablet. However, WPRCs 110*a*-110*c* can be any device or system that needs power and is capable of receiving wireless power via one or more integrated WPRCs. Although three WPRCs 110*a*-110*c* are depicted, any number of WPRCs may be supported. As discussed herein, a WPRC may include one or more integrated power receivers configured to receive and process power from one or more WPTSs and provide the power to the WPRCs 110*a*-110*c* or to internal batteries of the WPRCs 110*a*-110*c* for operation thereof.

As described herein, each of the WPRCs 110*a*-110*c* can be any system and/or device, and/or any combination of devices/systems that can establish a connection with another device, a server and/or other systems within the example wireless power transmission environment 100. In some embodiments, the WPRCs 110*a*-110*c* may each include displays or other output functionalities to present or transmit data to a user and/or input functionalities to receive data from the user. By way of example, WPRC 110*a* can be, but is not limited to, a video game controller, a server desktop, a desktop computer, a computer cluster, a mobile computing device such as a notebook, a laptop computer, a handheld computer, a mobile phone, a smart phone, a PDA, a Blackberry device, a Treo, and/or an iPhone, etc. By way of example and not limitation, WPRC 110*a* can also be any wearable device such as watches, necklaces, rings or even devices embedded on or within the customer. Other examples of WPRC 110*a* include, but are not limited to, a safety sensor, e.g. a fire or carbon monoxide sensor, an electric toothbrush, an electronic door lock/handle, an electric light switch controller, an electric shaver, an electronic shelf label (ESL), etc.

Although not illustrated in the example of FIG. 1, the WPTS 101 and the WPRCs 110*a*-110*c* can each include a data communication module for communication via a data channel. Alternatively, or additionally, the WPRCs 110*a*-110*c* can direct antennas to communicate with WPTS 101 via existing data communications modules. In some embodiments, the WPTS 101 can have an embedded Wi-Fi hub for data communications via one or more antennas or transceivers. In some embodiments, the antennas 103*a*-103*n* can communicate via Bluetooth™, Wi-Fi™, ZigBee™, etc. The WPRCs 110*a*-110*c* may also include an embedded Bluetooth™, Wi-Fi™, ZigBee™, etc. transceiver for communicating with the WPTS 101. Other data communication protocols are also possible. In some embodiments the beacon signal, which is primarily referred to herein as a continuous waveform, can alternatively or additionally take the form of a modulated signal and/or a discrete/pulsed signal.

WPTS 101 may also include control circuit 102. Control circuit 102 may be configured to provide control and intelligence to the WPTS 101 components. Control circuit 102 may comprise one or more processors, memory units, etc., and may direct and control the various data and power communications. Control circuit 102 may direct data communications on a data carrier frequency that may be the same or different than the frequency via which wireless power is delivered. Likewise, control circuit 102 can direct wireless transmission system 100 to communicate with WPRCs 110*a*-110*c* as discussed herein. The data communications can be, by way of example and not limitation, Bluetooth™, Wi-Fi™, ZigBee™, etc. Other communication protocols are possible.

It is appreciated that the use of the term "WPTS" does not necessarily limit the WPTS to any specific structure. That is, the WPTS does not need to be structured in a specific form or geometry. Furthermore, as used herein the term "transmission system" or "WPTS" may be used to include related and peripheral circuitry for signal generation, reception and transmission, such as radios, digital circuits and modems.

Figure 2:
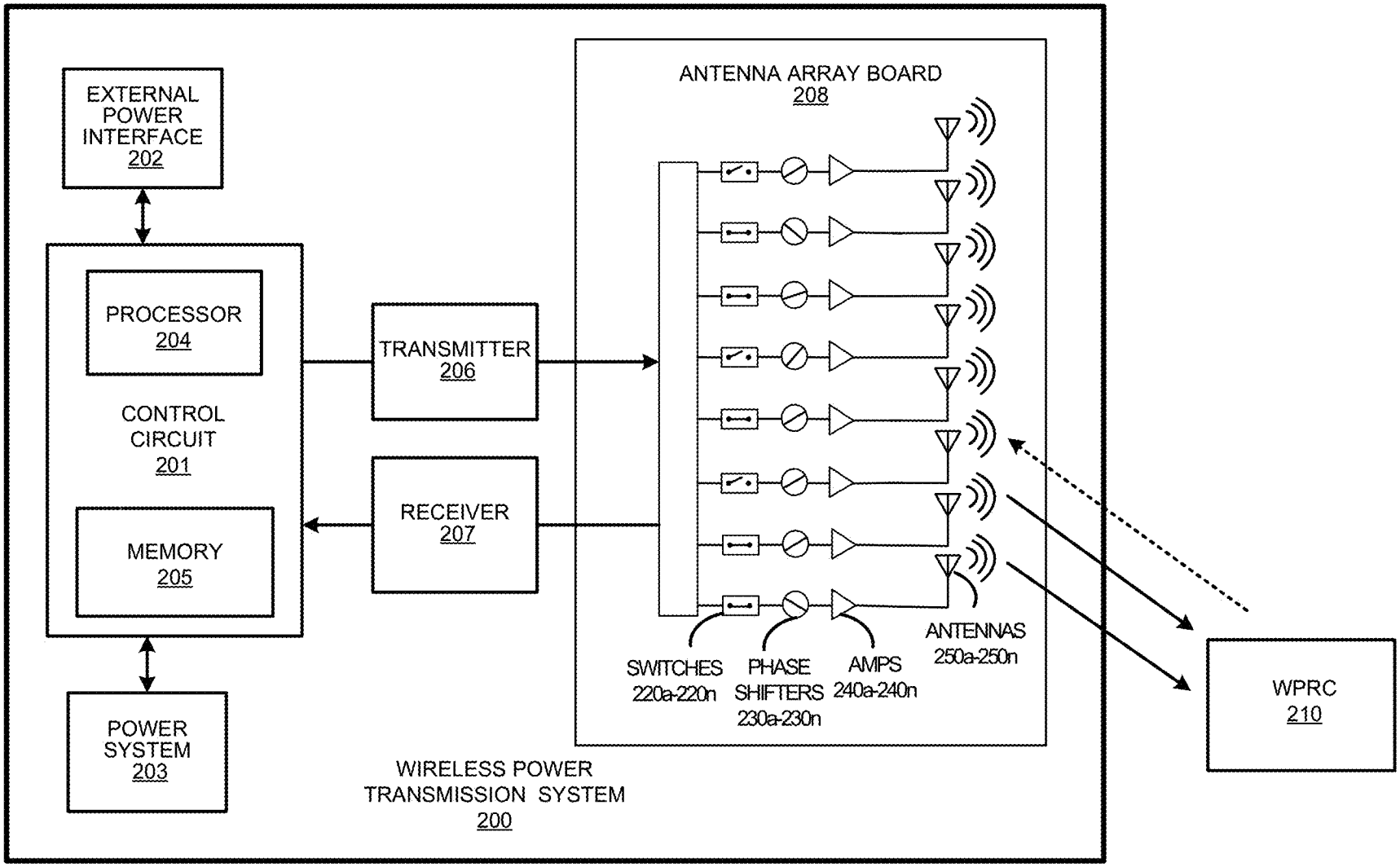
FIG. 2 is a block diagram illustrating example components of an example embodiment of a wireless power transmission system (WPTS).

FIG. 2 is a block diagram illustrating example components of a WPTS 200 in accordance with the embodiments described herein. As illustrated in the example of FIG. 2, the WPTS 200 may include a control circuit 201, external power interface 202, and power system 203. Control circuit 201 may include processor 204, for example a base band processor, and memory 205. Additionally, although only one antenna array board 208 and one transmitter 206 are depicted in FIG. 2, WPTS 200 may include one or more transmitters 206 coupled to one or more antenna array boards 208 and transmit signals to the one or more antenna array boards 208. Although only one receiver is depicted in FIG. 2, one or more receivers 207 may be coupled to the one or more antenna array boards 208 and may receive signals from the one or more antennas 250*a*-250*n* of the one or more antenna array boards 208. Each antenna array board 208 includes switches 220*a*-220*n*, phase shifters 230*a*-230*n*, power amplifiers 240*a*-240*n*, and antenna arrays 250*a*-250*n*. Although each switch, phase shifter, power amplifier, and antenna is depicted in a one-to-one relationship, this should not be construed as limiting. Additionally or alternatively, any number of switches, phase shifters, power amplifiers, and antennas may be coupled. Some or all of the components of the WPTS 200 can be omitted, combined, or sub-divided in some embodiments. Furthermore, the setting of the switches 220*a*-220*n* and phase shifters 230*a*-230*n* should not be construed as limiting. Any of the switches 220*a*-220*n*, phase shifters 230*a*-230*n*, and/or power amplifiers 240*a*-240*n*, or any combination thereof, may be individually controlled or controlled in groups. The signals transmitted and received by the one or more antenna array boards 208 may be wireless power signals, wireless data signals, or both.

Control circuit 201 is configured to provide control and intelligence to the array components including the switches 220*a*-220*n*, phase shifters 230*a*-230*n*, power amplifiers 240*a*-240*n*, and antenna arrays 250*a*-250*n*. Control circuit 201 may direct and control the various data and power communications. Transmitter 206 can generate a signal comprising power or data communications on a carrier frequency. The signal can be comply with a standardized format such as Bluetooth™, Wi-Fi™, ZigBee™, etc., including combinations or variations thereof. Additionally or alternatively, the signal can be a proprietary format that does not use Bluetooth™, Wi-Fi™, ZigBee™, and the like, and utilizes the same switches 220*a*-220*n*, phase shifters 230*a*-230*n*, power amplifiers 240*a*-240*n*, and antenna arrays 250*a*-250*n* to transmit wireless data as are used to transmit wireless power. Such a configuration may save on hardware complexity and conserve power by operating independently of the constraints imposed by compliance with the aforementioned standardized formats. In some embodiments, control circuit 201 can also determine a transmission configuration comprising a directional transmission through the control of the switches 220*a*-220*n*, phase shifters 230*a*-230*n*, and amplifiers 240*a*-240*n* based on an encoded beacon signal received from a WPRC 210.

The external power interface 202 is configured to receive external power and provide the power to various components. In some embodiments, the external power interface 202 may be configured to receive, for example, a standard external 24 Volt power supply. In other embodiments, the external power interface 202 can be, for example, 120/240 Volt AC mains to an embedded DC power supply which may source, for example, 12/24/48 Volt DC to provide the power to various components. Alternatively, the external power interface could be a DC supply which may source, for example, 12/24/48 Volts DC. Alternative configurations including other voltages are also possible.

Switches 220*a*-220*n* may be activated to transmit power and/or data and receive encoded beacon signals based on the state of the switches 220*a*-220*n*. In one example, switches 220*a*-220*n* may be activated, e.g. closed, or deactivated, e.g. open, for power transmission, data transmission, and/or encoded beacon reception. Additional components are also possible. For example, in some embodiments phase-shifters 230*a*-230*n* may be included to change the phase of a signal when transmitting power or data to a WPRC 210. Phase shifter 230*a*-230*n* may transmit a power or data signal to WPRC 210 based on a phase of a complex conjugate of the encoded beaconing signal from WPRC 210. The phase-shift may also be determined by processing the encoded beaconing signal received from WPRC 210 and identifying WPRC 210. WPTS 200 may then determine a phase-shift associated with WPRC 210 to transmit the power signal. In an example embodiment, data transmitted from the WPTS 200 may be in the form of communication beacons which may be used to synchronize clocks with WPRC 210. This synchronization may improve the reliability of beacon phase detection.

In operation, control circuit 201, which may control the WPTS 200, may receive power from a power source over external power interface 202 and may be activated. Control circuit 201 may identify an available WPRC 210 within range of the WPTS 200 by receiving an encoded beacon signal initiated by the WPRC 210 via at least a portion of antennas 250*a*-250*n*. When the WPRC 210 is identified based on the encoded beacon signal, a set of antenna elements on the WPTS may power on, enumerate, and calibrate for wireless power and/or data transmission. At this point, control circuit 201 may also be able to simultaneously receive additional encoded beacon signals from other WPRCs via at least a portion of antennas 250*a*-250*n*.

Once the transmission configuration has been generated and instructions have been received from control circuit 201, transmitter 206 may generate and transfer one or more power and/or data signal waves to one or more antenna boards 208. Based on the instruction and generated signals, at least a portion of power switches 220*a*-220*n* may be opened or closed and at least a portion of phase shifters 230*a*-230*n* may be set to the appropriate phase associated with the transmission configuration. The power and/or data signal may then be amplified by at least a portion of power amplifiers 240*a*-240*n* and transmitted at an angle directed toward a location of WPRC 210. As discussed herein, at least a portion of antennas 250*a*-250*n* may be simultaneously receiving encoded beacon signals from additional WPRCs 210.

As described above, a WPTS 200 may include one or more antenna array boards 208. In one embodiment, each antenna array board 208 may be configured to communicate with a single WPRC 210, so that a different antenna array board 208 of a plurality of antenna array boards 208 communicates with a different WPRC 210 of a plurality of WPRCs 210. Such an implementation may remove a reliance on a communication method, such as a low-rate personal area network (LR-WPAN), IEEE 802.15.4, or Bluetooth Low Energy (BLE) connection to synchronize with a WPRC 210. A WPTS 200 may receive a same message from a WPRC 210 via different antennas of antennas 250*a*-250*n*. The WPTS 200 may use the replication of the same message across the different antennas to establish a more reliable communication link. In such a scenario, a beacon power may be lowered since the lower power can be compensated by the improved reliability owed to the replicated received signals. In some embodiments, it may also be possible to dedicate certain antennas or groups of antennas for data communication and dedicate other antennas or groups of antennas for power delivery. For example, an example WPTS 200 may dedicate 8 or 16 antennas of antennas 250*a*-250*n* to data communication at a lower power level than some number of remaining antennas that may be dedicated to power delivery at a relatively higher power level than the data communication.

Figure 3:
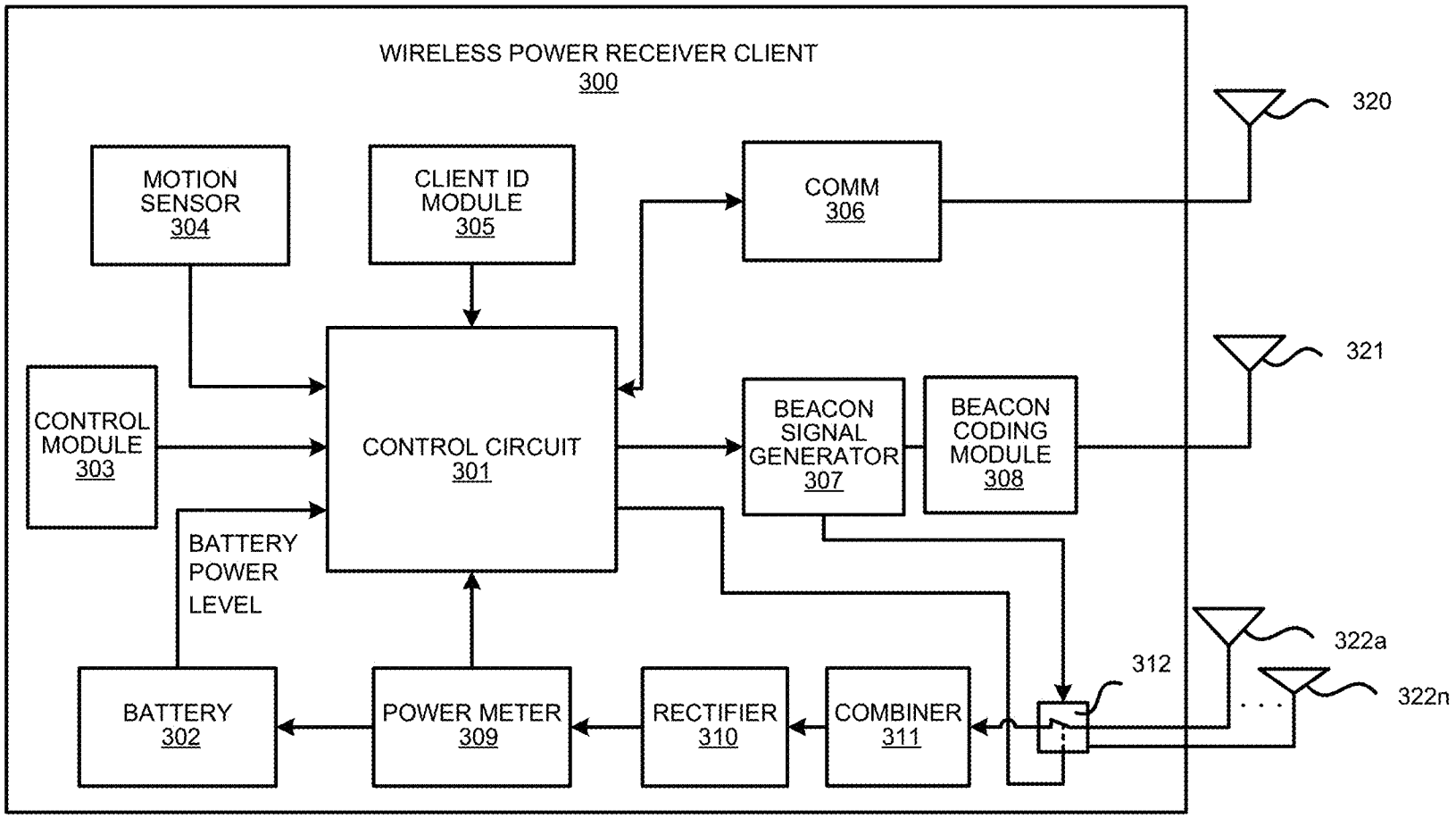
FIG. 3 is a block diagram illustrating an example embodiment of a wireless power receiver client (WPRC).

FIG. 3 is a block diagram illustrating an example WPRC 300 in accordance with embodiments described herein. As shown in the example of FIG. 3, WPRC 300 may include control circuit 301, battery 302, a control module 303, for example an Internet of Things (IoT) control module, communication block 306 and associated one or more antennas 320, power meter 309, rectifier 310, a combiner 311, beacon signal generator 307, beacon coding unit 308 and associated one or more antennas 321, and switch 312 connecting the combiner 311 or the beacon signal generator 307 to one or more associated antennas 322*a*-322*n*. The battery 302 may alternatively be replaced by a capacitor. Although not depicted, the WPRC 300 may include an energy harvesting circuit which may enable the WPRC 300 to operate with a capacitor for short term energy storage instead of or in addition to using the battery. Some or all of the depicted components in FIG. 3 can be omitted, combined, or subdivided in some embodiments. Some or all of the components depicted in FIG. 3 may be incorporated in a single integrated chip (IC). It should be noted that although the WPTS 200 may use full-duplexing, WPRC 300 may additionally or alternatively use half-duplexing. A received and/or transmitted data rate may be, for example, 20 Mbps. However, higher or lower data rates may be implemented to achieve other design goals. The WPRC 300 may transmit acknowledgement (ACK) messages back to a WPTS, such as a WPTS 200 depicted in FIG. 2. Although not depicted, a local CPU may be incorporated into WPRC 300. For example, the local CPU may be included in the control circuit 301.

A combiner 311 may receive and combine the received power and/or data transmission signals received via one or more antennas 322*a*-322*n*. The combiner can be any combiner or divider circuit that is configured to achieve isolation between output ports while maintaining a matched condition. For example, the combiner 311 can be a Wilkinson Power Divider circuit. The combiner 311 may be used to combine two or more RF signals while maintaining a characteristic impedance, for example, 50 ohms. The combiner 311 may be a resistive-type combiner, which uses resistors, or a hybrid-type combiner, which uses transformers. The rectifier 310 may receive the combined power transmission signal from the combiner 311, if present, which may be fed through the power meter 309 to the battery 302 for charging. In other embodiments, each antenna's power path can have its own rectifier 310 and the DC power out of the rectifiers is combined prior to feeding the power meter 309. The power meter 309 may measure the received power signal strength and may provide the control circuit 301 with this measurement.

Battery 302 may include protection circuitry and/or monitoring functions. Additionally, the battery 302 may include one or more features, including, but not limited to, current limiting, temperature protection, over/under voltage alerts and protection, and battery capacity monitoring, for example coulomb monitoring. The control circuit 301 may receive the battery power level from the battery 302 itself. As indicated above, although not shown, a capacitor may be substituted for the battery 302 or may be implemented in addition to the battery 302. The control circuit 301 may also transmit/receive via the communication block 306 a data signal on a data carrier frequency, such as the base signal clock for clock synchronization. The beacon signal generator 307 may generate the beacon signal or calibration signal and may transmit the beacon signal or calibration signal using one or more antennas 321.

It may be noted that, although the battery 302 is shown as charged by, and providing power to, WPRC 300, the receiver may also receive its power directly from the rectifier 310. This may be in addition to the rectifier 310 providing charging current to the battery 302, or in lieu of providing charging. Also, it may be noted that the use of multiple antennas 320, 321, and 322*a*-322*n* is one example of implementation, however the structure may be reduced to one shared antenna.

In some embodiments, the control circuit 301 and/or the control module 303 can communicate with and/or otherwise derive device information from WPRC 300. The device information can include, but is not limited to, information about the capabilities of the WPRC 300, usage information of the WPRC 300, power levels of the battery or batteries 302 of the WPRC 300, and/or information obtained or inferred by the WPRC 300. In some embodiments, a client identifier (ID) module 305 stores a client ID that can uniquely identify the WPRC 300 in a wireless power delivery environment. For example, the ID can be transmitted to one or more WPTSs in the encoded beacon signal. In some embodiments, WPRCs may also be able to receive and identify other WPRCs in a wireless power delivery environment based on the client ID.

A motion sensor 304 can detect motion and may signal the control circuit 301 to act accordingly. For example, a device receiving power may integrate motion detection mechanisms such as accelerometers or equivalent mechanisms to detect motion. Once the device detects that it is in motion, it may be assumed that it is being handled by a user, and may trigger a signal to the antenna array of the WPTS to either stop transmitting power and/or data, or to initiate wireless power and/or data transmission from the WPTS. The WPRC may use the encoded beacon or other signaling to communicate with the WPTS. In some embodiments, when a WPRC 300 is used in a moving environment like a car, train or plane, the power might only be transmitted intermittently or at a reduced level unless the WPRC 300 is critically low on power.

Figure 4:
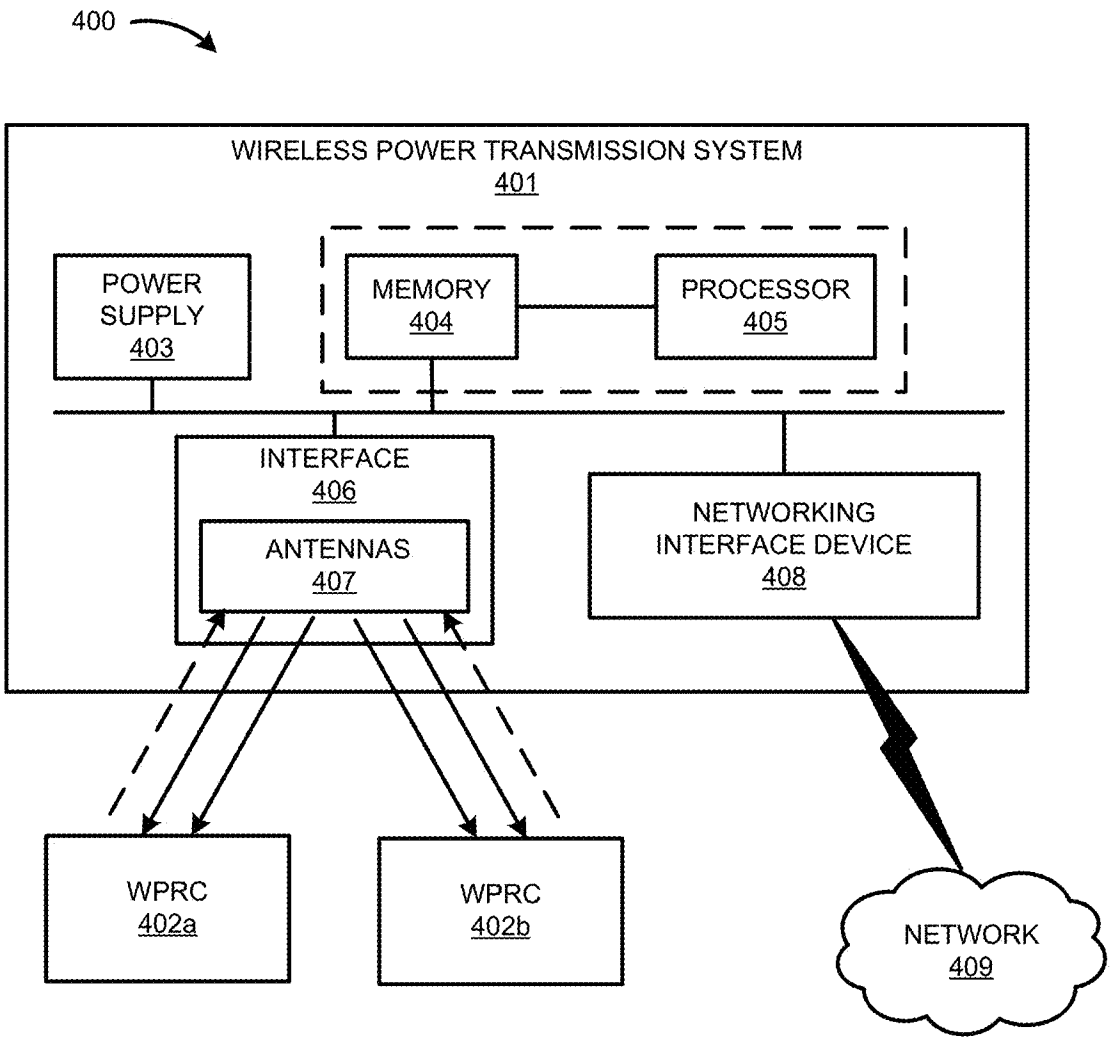
FIG. 4 is a diagram illustrating an example embodiment of a wireless signal delivery environment.
Figure 5A:
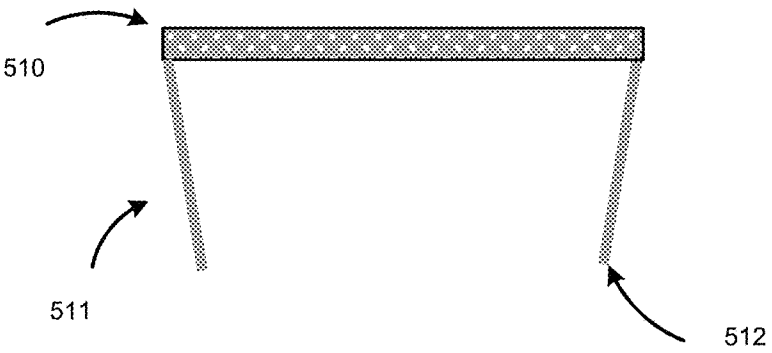
FIGS. 5A-5D depict example embodiments of a WPTS with aperture expansion flaps.
Figure 5B:
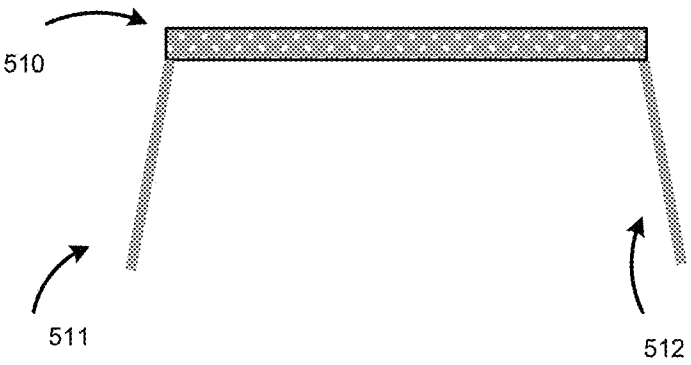
Figure 5C:
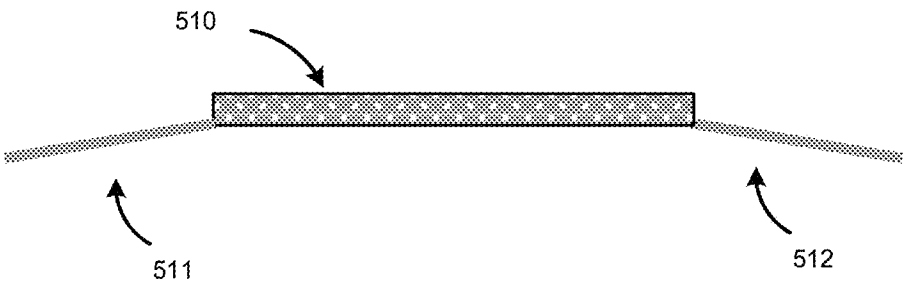
Figure 5D:
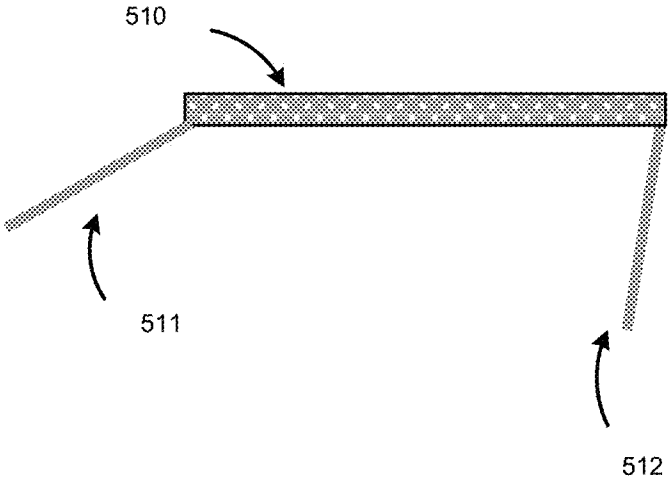

FIG. 4 is a diagram illustrating an example wireless signal delivery environment 400 in accordance with embodiments described herein. The wireless signal delivery environment 400 includes WPTS 401, a user operating WPRCs 402*a* and 402*b*, and wireless network 409. Although two WPRCs are depicted in FIG. 4, any number of WPRCs may be supported. WPTS 401 as depicted in FIG. 4 can alternatively be implemented in accordance with WPTS 101 as depicted in FIG. 1. Alternative configurations are also possible. Likewise, WPRCs 402*a* and 402*b* as depicted in FIG. 4 can be implemented in accordance with WPRCs 110*a*-110*c* of FIG. 1, or can be implemented in accordance with WPRC 300 as depicted in FIG. 3, although alternative configurations are also possible.

WPTS 401 may include a power supply 403, memory 404, processor 405, interface 406, one or more antennas 407, and a networking interface device 408. Some or all of the components of the WPTS 401 can be omitted, combined, or sub-divided in some embodiments. The networking interface device may communicate wired or wirelessly with a network 409 to exchange information that may ultimately be communicated to or from WPRCs 402*a* and 402*b*. The one or more antennas 407 may also include one or more receivers, transmitters, and/or transceivers. The one or more antennas 407 may have a radiation and reception pattern directed in a space proximate to WPRC 402*a*, WPRC 402*b*, or both, as appropriate. WPTS 401 may transmit a wireless power signal, wireless data signal, or both over at least a portion of antennas 407 to WPRCs 402*a* and 402*b*. As discussed herein, WPTS 401 may transmit the wireless power signal, wireless data signal, or both at an angle in the direction of WPRCs 402*a* and 402*b* such that the strength of the respectively received wireless signal by WPRCs 402*a* and 402*b* depends on the accuracy of the directivity of the corresponding directed transmission beams from at least a portion of antennas 407.

A fundamental property of antennas is that the receiving pattern of an antenna when used for receiving is directly related to the radiation pattern of the antenna when used for transmitting. This is a consequence of the reciprocity theorem in electromagnetics. The radiation pattern can be any number of shapes and strengths depending on the directivity of the beam created by the waveform characteristics and the types of antennas used in the antenna design of the antennas 407. The types of antennas 407 may include, for example, horn antennas, simple vertical antenna, etc. The antenna radiation pattern can comprise any number of different antenna radiation patterns, including various directive patterns, in a wireless signal delivery environment 400. By way of example and not limitation, wireless power transmit characteristics can include phase settings for each antenna and/or transceiver, transmission power settings for each antenna and/or transceiver, or any combination of groups of antennas and transceivers, etc.

As described herein, the WPTS 401 may determine wireless communication transmit characteristics such that, once the antennas and/or transceivers are configured, the multiple antennas and/or transceivers are operable to transmit a wireless power signal and/or wireless data signal that matches the WPRC radiation pattern in the space proximate to the WPRC. Advantageously, as discussed herein, the wireless signal, including a power signal, data signal, or both, may be adjusted to more accurately direct the beam of the wireless signal toward a location of a respective WPRC, such as WPRCs 402*a* and 402*b* as depicted in FIG. 4.

The directivity of the radiation pattern shown in the example of FIG. 4 is illustrated for simplicity. It is appreciated that any number of paths can be utilized for transmitting the wireless signal to WPRCs 402*a* and 402*b* depending on, among other factors, reflective and absorptive objects in the wireless communication delivery environment. FIG. 4 depicts direct signal paths, however other signal paths, including multi-path signals, that are not direct are also possible.

The positioning and repositioning of WPRCs 402*a* and 402*b* in the wireless communication delivery environment may be tracked by WPTS 401 using a three-dimensional angle of incidence of an RF signal at any polarity paired with a distance that may be determined by using an RF signal strength or any other method. As discussed herein, an array of antennas 407 capable of measuring phase may be used to detect a wave-front angle of incidence. A respective angle of direction toward WPRCs 402*a* and 402*b* may be determined based on respective distance to WPRCs 402*a* and 402*b* and on respective power calculations. Alternatively, or additionally, the respective angle of direction to WPRCs 402*a* and 402*b* can be determined from multiple antenna array segments 407.

In some embodiments, the degree of accuracy in determining the respective angle of direction toward WPRCs 402*a* and 402*b* may depend on the size and number of antennas 407, number of phase steps, method of phase detection, accuracy of distance measurement method, RF noise level in environment, etc. In some embodiments, users may be asked to agree to a privacy policy defined by an administrator for tracking their location and movements within the environment. Furthermore, in some embodiments, the system can use the location information to modify the flow of information between devices and optimize the environment. Additionally, the system can track historical wireless device location information and develop movement pattern information, profile information, and preference information.

Disclosed herein are embodiments of an aperture expansion flap that may be used in conjunction with an antenna, which may be an antenna array. In one embodiment, the antenna array may be part of a WPTS that may be configured to wirelessly transmit power to one or more WPRC. The aperture expansion flap may include an actively tuned set of elements. In one embodiment, the set of elements may be a set of resonators. In some embodiments, a resonator may also be considered a mini-antenna. The set of elements may be grouped into one or more super cells. Within a super cell, the elements may vary in geometry in a controlled manner. The set of elements may scatter a wave front with a reflection phase that is dependent upon the particular element and its respective position. Each element of the collection of elements may respectively adjust the phase of an incident wireless signal, such as an RF wave, so that the wireless signal may be reflected at a reflection angle that may be different than an angle of incidence.

In one embodiment, the elements may be conductive resonators that may be tuned via sizing/geometry and additionally or alternatively may be tuned via active circuitry. The set of resonators may be tuned to control a respective adjusted phase variation of each resonator across the set of resonators to control an angle of reflection of a wireless signal. In another embodiment, an angle of reflection may be dynamically controlled by tuning the resonators. Additionally or alternatively, the resonators may be deactivated so that the resonators do not interact with the incident wireless signal and may therefore make the aperture expansion flap effectively transparent to the incident wireless signal.

By integrating one or more aperture expansion flaps into an antenna aperture of an existing antenna, such as that of a WPTS, the effective aperture of the antenna may be expanded beyond its original physical area, geometry, and/or orientation. Electronically controlling a reflection angle of an incident wireless signal by selectively tuning the resonators may add dimensions of freedom in radiation pattern synthesis, angular coverage, directivity, and/or adaptation of the antenna to the surroundings and physical environment.

One or more aperture expansion flaps may be integrated into, affixed to, or otherwise added to an antenna aperture on different sides of the antenna aperture, at different respective angles, with different sizes per aperture expansion flap, and/or with a different orientation. By controlling a particular phase adjustment of the resonators, the one or more aperture expansion flaps may relax installation limitations of an associated antenna and also of a particular orientation of the aperture expansion flap itself with respect to the antenna. Inclusion of one or more aperture expansion flaps in an antenna system may improve antenna performance parameters without complicated additional circuitry, power consumption, and/or design complexity.

FIGS. 5A-5D depict example embodiments of a WPTS 510 with aperture expansion flaps 511 and 512. In the example embodiments depicted in FIGS. 5A-5D, two aperture expansion flaps are shown, however, any number of aperture expansion flaps may be used. FIGS. 5A-5D also depict different positions for the aperture expansion flaps 511 and 512. The positions depicted are not meant to be limiting. The positions of the aperture expansion flaps 511 and 512 depicted in FIGS. 5A-5D may be fixed or may be mechanically controlled in conjunction with, for example, one or more motors, control and/or interface circuitry, and one or more processors. Although a WPTS 510 is depicted, any antenna may be used in conjunction with the aperture expansion flaps 511 and 512. Additionally, any position for any number of aperture expansion flaps is possible. For example, for a rectangular antenna aperture, four aperture expansion flaps may be used, wherein one aperture expansion flap is used per side.

Figure 6:
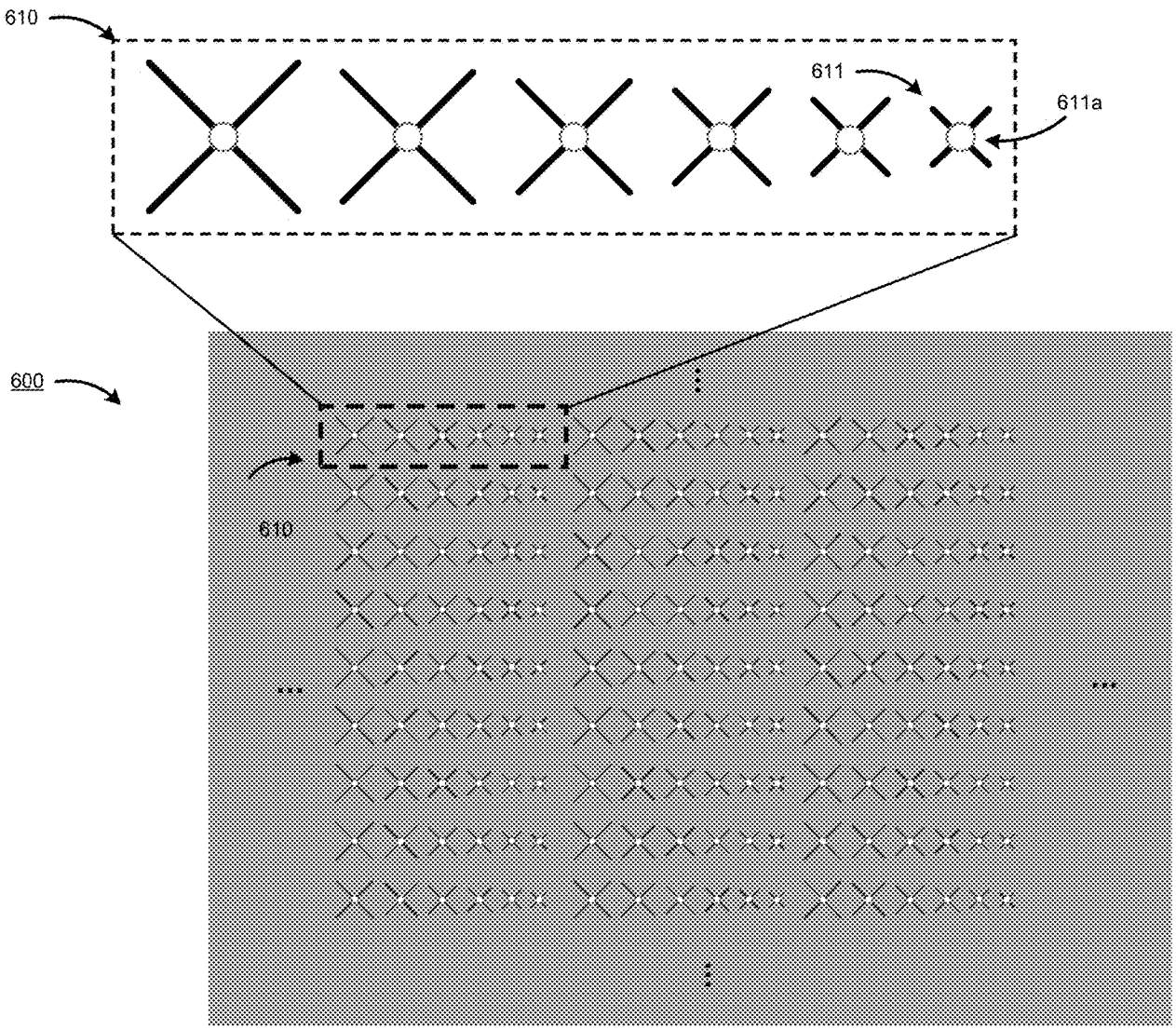
FIG. 6 depicts an example embodiment of an aperture expansion flap.

FIG. 6 depicts an example embodiment of an aperture expansion flap 600. Aperture expansion flap 600 may include one or more resonators 611. In one embodiment, a resonator 611 may be a mini-antenna. Additionally or alternatively, a resonator 611 may be made of any combination of metal, glass, quartz, or resin substrate. A resonator may also include active circuitry 611*a* to tune the resonator 611. The active circuitry 611*a* in FIG. 6 is depicted as a circle and is merely meant to symbolically represent active circuitry. It is not intended to imply a geometric property of the active circuitry. The active circuitry 611*a* may include transistors, capacitors, inductors, resistors, diodes, or any other suitable circuit components to tune a resonator 611. For example, a variable capacitor may be used to control a resonance of resonator 611. In one example, a size of a resonator 611 may influence a resonant frequency. For instance, a length of a metal used may adjust a resonant frequency. A variable capacitor may be used in conjunction with a particularly sized resonator 611 to tune the resonant frequency of the resonator. At a selected resonant frequency, a resonator 611 may reflect an incident wireless signal with a certain phase. Thus, a particularly sized resonator 611 may be tuned via active circuitry 611*a* to reflect an incident wireless signal with a desired adjusted phase.

As depicted in FIG. 6, an aperture expansion flap 600 may also include one or more super cells 610. FIG. 6 depicts an exploded view of super cell 610 which shows a set of resonators that is arranged along a length of the super cell 610. As depicted, the resonators may be arranged in a super cell such that they monotonically scale in size along the length of the super cell 610. Additionally or alternatively, the resonators may all be of a same size and each resonator may be tuned, for example electronically tuned via respective active circuitry 611*a*, so that an incident wireless signal may be reflected with a monotonically increasing/decreasing adjusted phase along the length of the super cell 610. Additionally or alternatively, the resonators may vary in size and each resonator may be tuned, for example electronically tuned via respective active circuitry 611*a*, so that an incident wireless signal may be reflected with a monotonically increasing/decreasing adjusted phase along the length of the super cell 610. In this way, an incident wave to the aperture expansion flap may be reflected at a reflection angle that is different than the angle of incidence. This reflection angle may be selected by tuning the set of resonators through scaling a size of the resonators, through electronically tuning the resonators, through both sizing and electronically tuning the resonators, or through any other suitable means, so that each resonator reflects the incident wave with a respective phase angle to result in the desired reflected angle of the incident wave.

In one embodiment, the aperture expansion flap may include a plurality of the same super cells 610. In another embodiment, the aperture expansion flap may include differently arranged super cells. In another embodiment, all super cells may be oriented in a same direction such that the resonators of each super cell are similarly arranged to adjust a phase in a similar fashion. For example, as depicted in FIG. 6, all super cells are arranged such that the largest resonator of each super cell is on the far left of the super cell, the smallest resonator of each super cell is on the far right of the super cell, and the resonators monotonically scale in size in a controlled fashion from the largest resonator to the smallest resonator. Viewed another way, the resonators adjust a phase of an incident wave in a monotonic fashion from one end of the super cell to the other. Thus, additionally or alternatively, active circuitry such as 611*a* may be used for each resonator to select a respective adjusted phase angle at which to reflect an incident wireless signal, wherein the phase is monotonically adjusted along a length of a super cell. Although a particular number of resonators 611 per super cell 610 are shown, any number of resonators 611 and super cells 610 may be used.

Although the super cells 610 in FIG. 6 are depicted with a particular height and width, this is not meant to be limiting. Other dimensions and shapes for a super cell 610 are possible. In one embodiment, a longer side of a super cell 610 may be less than a wavelength of a shortest wavelength of a wireless signal to be reflected. In another embodiment, the longer side of the super cell 610 may be less than half of the shortest wavelength of the wireless signal to be reflected. The shorter side of super cell 610 may be shorter than the length of the longer side. Additionally or alternatively, a super cell need not be rectangular in shape. For example, a super cell may be circular, trapezoidal, hexagonal, etc. In the example aperture expansion flap 600 depicted in FIG. 6, the resonators 611 are depicted in a single horizontal row per super cell 610. This is not meant to be limiting. Additionally or alternatively, a super cell 610 may include a set of resonators arranged in multiple rows, arranged in a staggered pattern, arranged vertically, or any other arrangement suitable for adjusting the angle of reflection of an incident wave.

A surface area of an aperture expansion flap 600 may be any size. In one embodiment, an aperture expansion flap 600 may be several times as long in each direction as a longest wavelength intended to be reflected. In another example, an aperture expansion flap may be covered as much as possible by resonators 611. In another example, resonators 611 of an aperture expansion flap 600 may be deactivated. For example, a transmitting antenna array may achieve a desired direction of transmission without a need for an aperture expansion flap 600. In this example, resonators 611 may be deactivated so that they do not resonate and as a result a wave is not affected by the resonators. This may prevent a loss of efficiency of operation by the transmitting antenna array.

Although the resonators 611 in FIG. 6 are depicted as crosses, any shape may be used. For example, resonators may be shaped like a dog bone, a 'Y' shape, or any other suitable shape or combination of shapes. Additionally or alternative, differently shaped resonators may be used within a same super cell and/or within a same aperture expansion flap. Additionally or alternatively, an antenna aperture may be augmented with differently configured aperture expansion flaps.

Although an incident wireless signal is described above as being reflected by the aperture expansion flap 600, the incident wireless signal may also be transmitted through the aperture expansion flap 600. In this way, a refraction angle of the incident wireless signal may be selected by tuning the resonators to direct the incident wireless signal through the aperture expansion flap with a desired refraction angle. Additionally or alternatively, an incident wireless signal may be both reflected and refracted by the aperture expansion flap 600.

Figure 7:
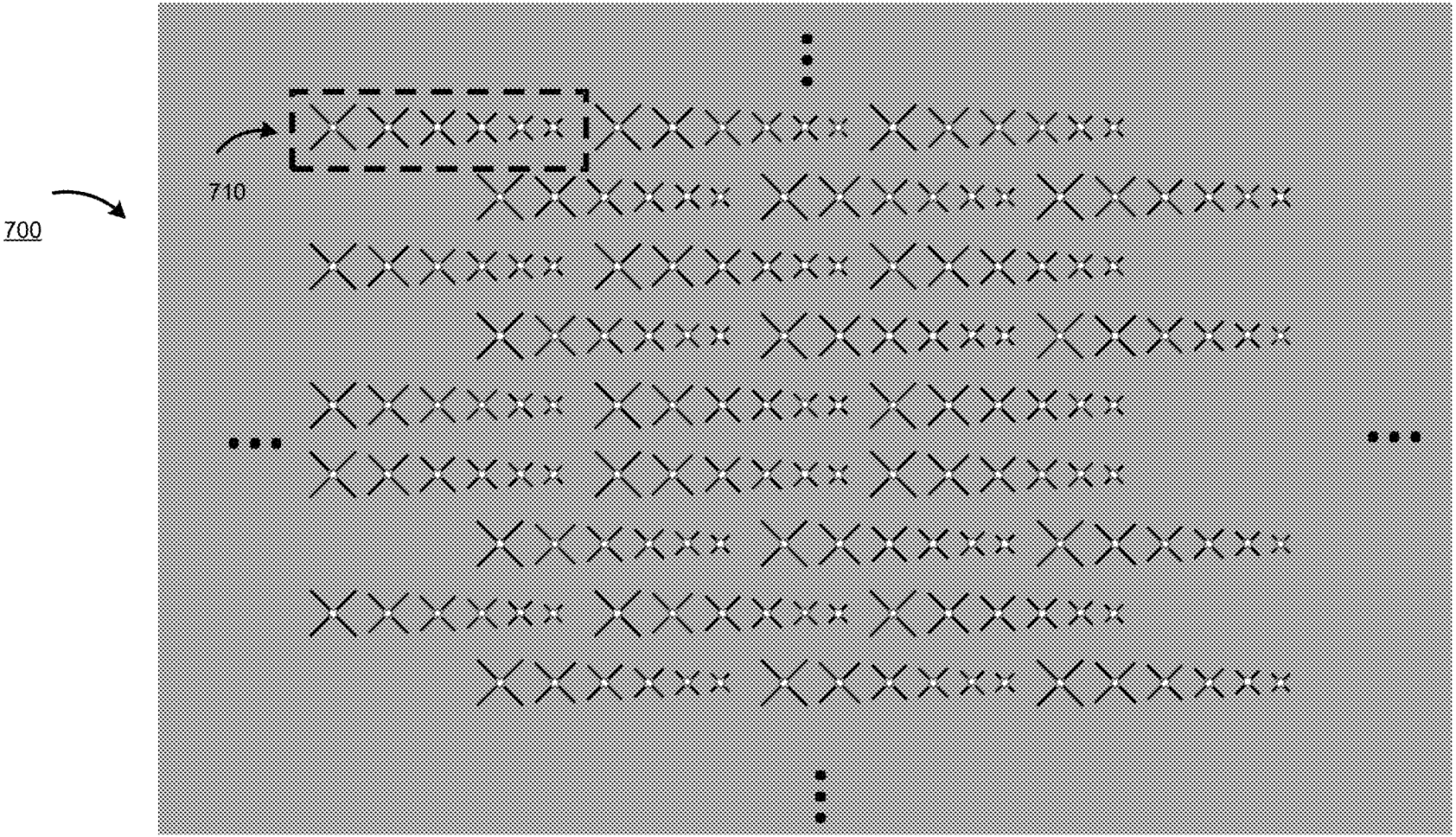
FIG. 7 depicts another example embodiment of an aperture expansion flap.

FIG. 7 depicts another example embodiment of an aperture expansion flap 700. As depicted in FIG. 7, the aperture expansion flap 700 may include a plurality of resonators and super cells 710 that may include a set of resonators. The pattern in which the super cells 610 are depicted in the aperture expansion flap 600 may be compared to the arrangement of super cells 710 shown in FIG. 7. In FIG. 6, the super cells 610 are uniformly arranged and repeating. In FIG. 7, the super cells are not uniformly arranged. For example, as shown in FIG. 7, some super cells 710 may be staggered with respect to each other across a surface area of the aperture expansion flap 700. In some embodiments, super cells 710 may be homogeneously or inhomogeneously arranged across the surface area of the aperture expansion flap 700.

Figure 8:
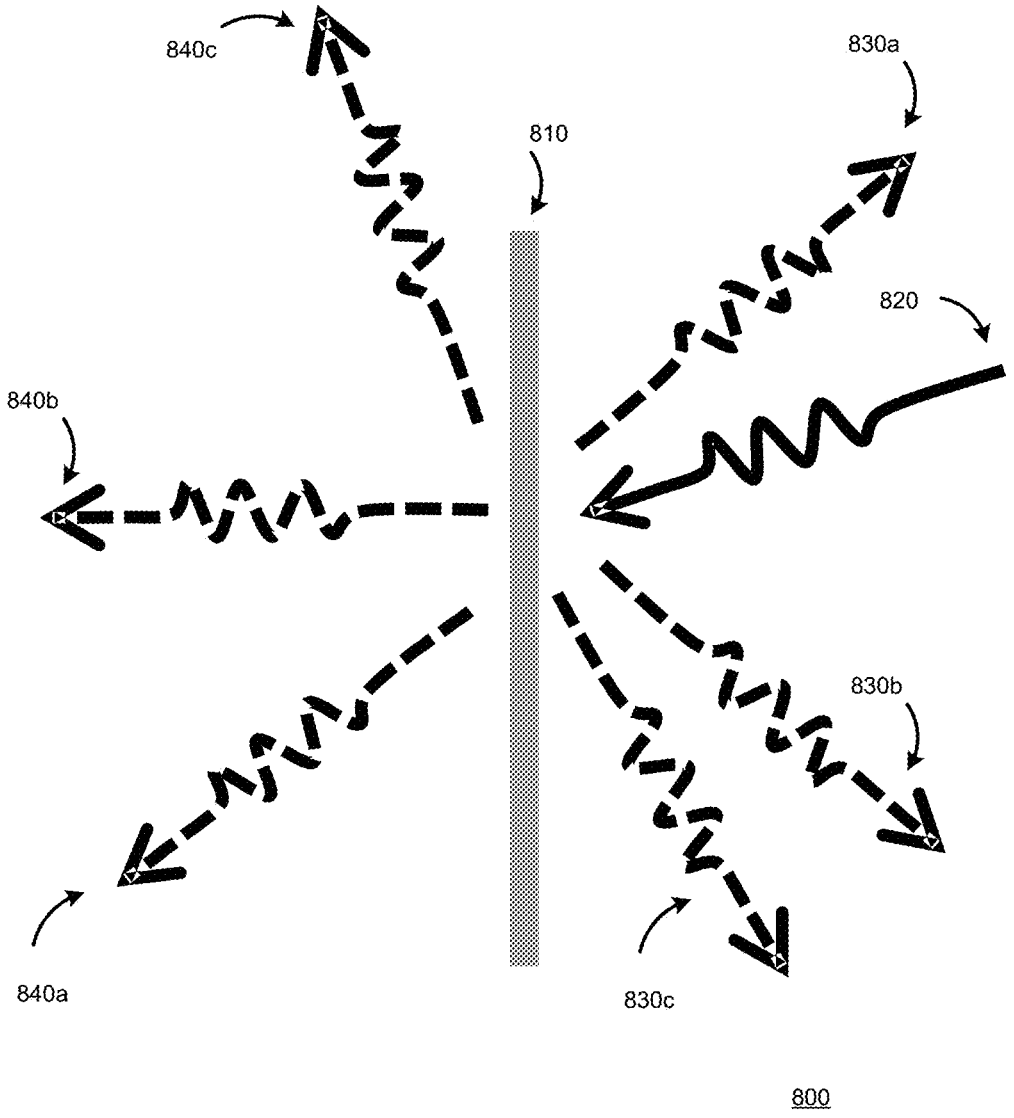
FIG. 8 depicts another example embodiment of an aperture expansion flap.

FIG. 8 depicts another example embodiment of an aperture expansion flap 810. An incident wireless signal 820 may be reflected at a desired angle of reflection such that the reflected wireless signal may be 830*a*, 830*b*, or 830*c* with an associated angle of reflection. Additionally or alternatively, the incident wireless signal 820 may be transmitted through the aperture expansion flap 810 at a desired angle of refraction such that the refracted wireless signal may be 840*a*, 840*b*, or 840*c*. Additionally or alternatively, the incident wireless signal may be reflected and/or refracted to form any combination of wireless signals 830*a*, 830*b*, 830*c*, 840*a*, 840*b*, and/or 840*c*. The particular angles of reflection and refraction shown in FIG. 8 are merely examples and are not meant to be limiting. Any angle of reflection and/or refraction may be selected by appropriately tuning the resonators. Additionally, FIG. 8 is depicted in 2-dimensions merely for ease of illustration and is not meant to limit signals within a single plane. The incident wireless signal 820, the reflected wireless signals 830*a*, 830*b*, and 830*c*, and/or the refracted wireless signals 840*a*, 840*b*, and 840*c* may be directed at any angle within the three spatial dimensions of space and need not all fall within a single plane. As explained above, resonators (not shown in FIG. 8) may be respectively tuned to reflect and/or refract an incident wireless signal with a respective adjusted phase, such that the wireless signal is reflected and/or refracted at a desired reflection and/or refraction angle, or combination of angles, that may be different than an angle of incidence.

Figure 9:
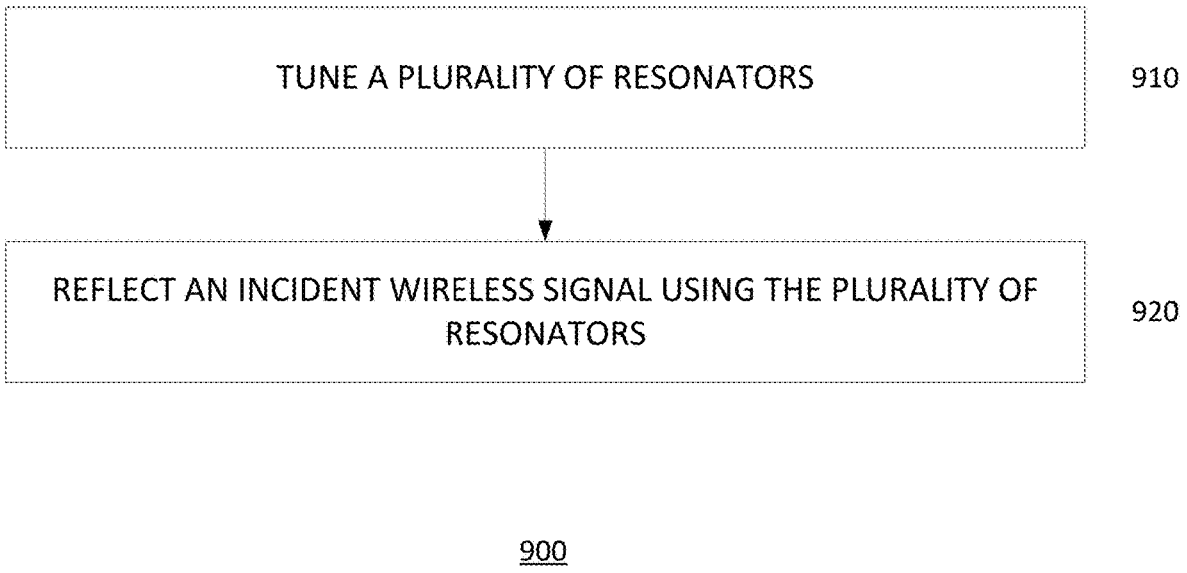
FIG. 9 depicts an example embodiment of a method of operating an aperture expansion flap.

FIG. 9 depicts an example embodiment of a method of operating an aperture expansion flap 900. At 910, a plurality of resonators may be tuned. As described above, a resonator may resonate with a tunable frequency that induces a phase shift in an incident wireless signal upon reflection. Each of the plurality of resonators may be tuned to reflect the incident wireless signal with a respectively adjusted phase, such that an effective aperture of the antenna is increased. At 920, the incident wireless signal may be reflected using the plurality of resonators, wherein each of the plurality of resonators reflects the incident wireless signal with its respectively adjusted phase. The resonators may be arranged into super cells, as described in greater detail above. The resonators may be tuned to reflect the incident wireless signal at an angle of reflection that may be different than an angle of incidence. The resonators may be tuned by active circuitry that may, for example, be controlled by a control circuit such as control circuit 201 in FIG. 2. The angle of reflection may be selected to steer a transmission in a desired direction. For example, a WPTS equipped with one or more aperture expansion flaps may direct a wireless power transmission to a location of a WPRC. In another example, a WPRC may be moving, and the WPTS in conjunction with one or more aperture expansion flaps may dynamically steer a focus of the wireless power transmission to a current location of the moving WPRC.

Figure 10:
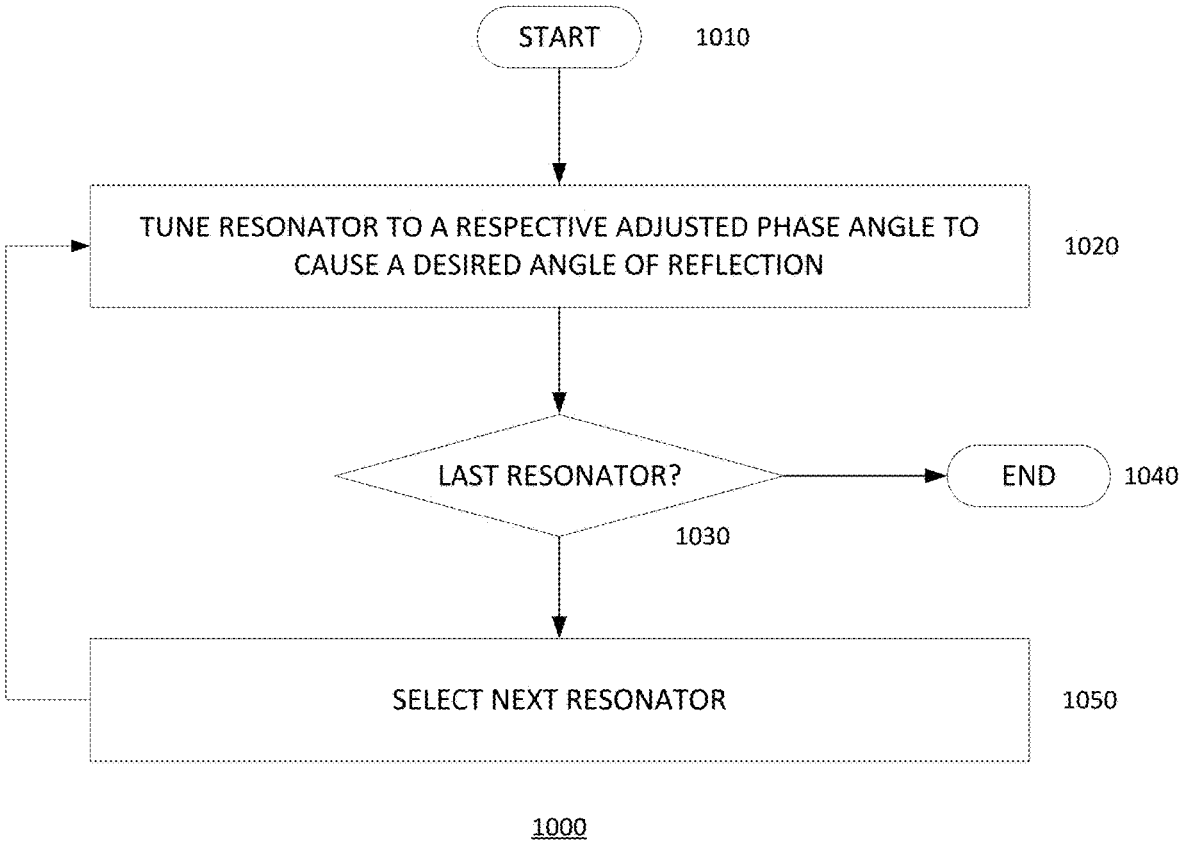
FIG. 10 depicts another example embodiment of a method of operating an aperture expansion flap.

FIG. 10 depicts another example embodiment of a method of operating an aperture expansion flap 1000. The method starts at 1010. At 1020, a resonator may be tuned to a respective adjusted phase angle to cause a desired angle of reflection for an incident wireless signal. At 1030, it is determined whether the last resonator has been tuned or not. If there are no more resonators and the last resonator has been tuned, the method may end at 1040. Alternatively, if there are additional resonators that need tuning to achieve the desired angle of reflection for the incident wireless signal, then at 1050 the next resonator is selected and then the method returns to 1020 to tune the next resonator appropriately. The resonators may be tuned by active circuitry that may, for example, be controlled by a control circuit such as control circuit 201 in FIG. 2. Although the particular steps of method 1000 are shown separated in a particular way, steps may be combined, split-up, or rearranged without departing from the spirit of the method. Additionally, although the method generally described tuning one resonator at a time, multiple resonators including up to all resonators may be tuned simultaneously. Additionally or alternatively, a tuning process of a first resonator may overlap in time with one or more other resonators.

Although features and elements are described above in particular combinations, one of ordinary skill in the art will appreciate that each feature or element can be used alone or in any combination with the other features and elements. In addition, the methods described herein may be implemented in a computer program, software, or firmware incorporated in a computer-readable medium for execution by a computer or processor. Examples of computer-readable media include electronic signals (transmitted over wired or wireless connections) and computer-readable storage media. Examples of computer-readable storage media include, but are not limited to, a read only memory (ROM), a random access memory (RAM), a register, cache memory, semiconductor memory devices, magnetic media such as internal hard disks and removable disks, magneto-optical media, and optical media such as CD-ROM disks, and digital versatile disks (DVDs). A processor in association with software may be used to implement a WPTS or WPRC.

What is claimed is:

1. An aperture expansion flap, configured to operate in conjunction with an antenna, the aperture expansion flap fixed in a first position with respect to the antenna, the aperture expansion flap comprising:

a plurality of resonators; and control circuitry configured to tune each resonator of the plurality of resonators to reflect a respective wireless signal incident upon the resonator with a respective adjusted phase, such that a wave incident upon the aperture expansion flap is reflected at a first angle of reflection of a plurality of angles of reflection while maintaining the aperture expansion flap in the first position, wherein the wave includes each of the wireless signals incident upon each respective resonators, and wherein the first angle of reflection is different than an angle at which the wave is incident upon the aperture expansion flap.

2. The aperture expansion flap of claim 1, wherein the plurality of resonators are arranged in a plurality of super cells, wherein each of the plurality of super cells includes a respective set of resonators of the plurality of resonators that is arranged along a length of a respective super cell.

3. The aperture expansion flap of claim 2, wherein a first resonator at a first end of a first super cell is tuned to reflect its respective incident wireless signal with a first adjusted phase, wherein a last resonator at another end of the first super cell is tuned to reflect its respective incident wireless signal with a last adjusted phase, wherein the first adjusted phase is less than the last adjusted phase, and wherein each resonator arranged along the length of the first super cell is respectively tuned to reflect its respective incident wireless signal with a monotonically larger adjusted phase from the first adjusted phase of the first resonator at the first end of the first super cell to the last adjusted phase of the last resonator at the another end of the first super cell.

4. The aperture expansion flap of claim 3, wherein all of the respective sets of resonators of the plurality of super cells are arranged in a same order.

5. The aperture expansion flap of claim 1, wherein an effective aperture of the antenna is increased.

6. The aperture expansion flap of claim 1, wherein each resonator is tuned by active circuitry.

7. The aperture expansion flap of claim 1, wherein the reflection angle is selectable based on a desired direction of transmission.

8. The aperture expansion flap of claim 1, wherein the control circuitry is further configured to tune each of the plurality of resonators to reflect its respective incident wireless signal with a second respective adjusted phase, such that the wave incident upon the aperture expansion flap is reflected at a second angle of reflection of the plurality of angles of reflection while maintaining the aperture expansion flap in the first position.

9. The aperture expansion flap of claim 1, wherein the antenna is part of wireless power transmission system (WPTS).

10. The aperture expansion flap of claim 9, wherein the plurality of resonators are configured to dynamically reflect the wave incident upon the aperture expansion flap to a current location of a wireless power receiver client (WPRC) to deliver wireless power to the WPRC.

11. A method of adjusting an angle of reflection of a wave from an antenna incident upon an aperture expansion flap, the method comprising:

tuning each resonator of a plurality of resonators to reflect a respective wireless signal incident upon the resonator with a respective adjusted phase, such that a wave incident upon the aperture expansion flap is reflected at a first angle of reflection of a plurality of angles of reflection while maintaining the aperture expansion flap in the first position, wherein the wave includes each of the wireless signals incident upon each respective resonators, and wherein the first angle of reflection is different than an angle at which the wave is incident upon the aperture expansion flap; and reflecting the incident wireless signals using the plurality of resonators, each resonator of the plurality of resonators reflecting its respective incident wireless signal with the respectively adjusted phase.

12. The method of claim 11, wherein the plurality of resonators are arranged in a plurality of super cells, wherein each of the plurality of super cells includes a respective set of resonators of the plurality of resonators that is arranged along a length of a respective super cell.

13. The method of claim 12, wherein a first resonator at a first end of a first super cell is tuned to reflect its respective incident wireless signal with a first adjusted phase, wherein a last resonator at another end of the first super cell is tuned to reflect its respective incident wireless signal with a last adjusted phase, wherein the first adjusted phase is less than the last adjusted phase, and wherein each resonator arranged along the length of the first super cell is respectively tuned to reflect its respective incident wireless signal with a monotonically larger adjusted phase from the first adjusted phase of the first resonator at the first end of the first super cell to the last adjusted phase of the last resonator at the another end of the first super cell.

14. The method of claim 13, wherein all of the respective sets of resonators of the plurality of super cells are arranged in a same order.

15. The method of claim 11, wherein an effective aperture of the antenna is increased.

16. The method of claim 11, wherein the tuning each resonator includes tuning by active circuitry.

17. The method of claim 11, wherein the reflection angle is selectable based on a desired direction of transmission.

18. The method of claim 17, further comprising:

tuning each of the plurality of resonators to reflect its respective incident wireless signal with a second respective adjusted phase, such that the wave incident upon the aperture expansion flap is reflected at a second angle of reflection of the plurality of angles of reflection while maintaining the aperture expansion flap in the first position.

19. The method of claim 11, wherein the antenna is part of wireless power transmission system (WPTS).

20. The method of claim 19, wherein the wave incident upon the aperture expansion flap is dynamically reflected to a current location of a wireless power receiver client (WPRC) to deliver wireless power to the WPRC.

* * * * *